US007448555B2

(12) United States Patent
Wollin

(10) Patent No.: US 7,448,555 B2
(45) Date of Patent: Nov. 11, 2008

(54) SPRAYING TOOL FOR CASTING MOLDS

(75) Inventor: Rudolf Wollin, Lorch (DE)

(73) Assignee: Wotec Automationssysteme GmbH, Schorndorf-Schlichten (DE)

( * ) Notice: Subject to any disclaimer, the term of this patent is extended or adjusted under 35 U.S.C. 154(b) by 0 days.

(21) Appl. No.: 10/560,580

(22) PCT Filed: Jun. 14, 2004

(86) PCT No.: PCT/DE2004/001206

§ 371 (c)(1),
(2), (4) Date: Jun. 20, 2006

(87) PCT Pub. No.: WO2004/112969

PCT Pub. Date: Dec. 29, 2004

(65) Prior Publication Data

US 2007/0075164 A1 Apr. 5, 2007

(30) Foreign Application Priority Data

Jun. 13, 2003 (DE) ..... 103 27 096

(51) Int. Cl.
*B05B 1/28* (2006.01)
*A62C 31/02* (2006.01)

(52) U.S. Cl. ..... 239/296; 239/267; 239/412; 239/268; 239/390; 239/392; 427/133; 427/236; 118/306

(58) Field of Classification Search ..... 239/267, 239/397, 412, 8, 268, 390, 392; 427/133, 427/421, 236; 118/306, 316, 318
See application file for complete search history.

(56) References Cited

U.S. PATENT DOCUMENTS

| | | | | |
|---|---|---|---|---|
| 4,760,961 | A * | 8/1988 | Nagai | 239/267 |
| 5,603,984 | A * | 2/1997 | Keim et al. | 427/133 |
| 5,916,367 | A * | 6/1999 | Wollin | 118/306 |
| 6,722,587 | B2 * | 4/2004 | Hanano | 239/548 |

FOREIGN PATENT DOCUMENTS

| | | |
|---|---|---|
| DE | 34 31 253 | 3/1986 |
| DE | 36 40 818 | 6/1988 |
| DE | 37 09 956 | 10/1988 |
| DE | 44 20 679 | 3/1995 |
| DE | 44 37 777 | 6/1995 |
| EP | 0 398 389 | 11/1990 |
| EP | 0 724 486 | 8/1996 |

* cited by examiner

*Primary Examiner*—Len Tran
*Assistant Examiner*—James S Hogan
(74) *Attorney, Agent, or Firm*—Jordan and Hamburg LLP

(57) ABSTRACT

Spraying tool for foundry molds with spraying nozzles, which can be controlled separately for several media per spraying nozzle and/or for a spraying nozzle per medium.

19 Claims, 8 Drawing Sheets

SPRAYING TOOL FOR CASTING MOLDS

BACKGROUND OF THE INVENTION

The invention relates to a spraying tool.

The invention starts out from a spraying tool of the class of claim 1.

For the spraying technique, described in the German patent 36 40 818 and in use at the time that this patent was published, with the consecutive spraying processes using materials that evolve toxic gases, the same atomizing nozzles were used for the various materials, although the spraying was carried out at different times. This also led to an expenditure of time, which can hardly be justified anymore at the present time. Moreover, at that time, and partly also at the present time, single pipe hose lines were used for the media, which led to the spraying nozzle. This is not only very expensive, but also, with the typical occurrence of contamination in a foundry, leads to breakdowns and an increased expenditure of work, since the hoses must be encapsulated. Furthermore, such hose systems are expensive and the reject rate is too high from the present point of view.

In the EP 0 724 486 B1, a spraying tool concept of the modular type is already described, for which all spraying nozzles of each spraying strip are controlled equally. For this modular system, there are up to eight different spraying strips, each with a spraying circle. Since the casting molds are constantly becoming larger and more complex and the spraying and blowing functions proceed in all possible directions and sequences, the spatial integration of eight different spraying circles becomes expensive and increases the weight drastically. Moreover, all spraying nozzles of a spraying circle are connected identically and, with that, not specifically to satisfy the requirements.

SUMMARY OF THE INVENTION

On the other hand, the inventive spraying tool has the advantage that the spraying nozzles are controlled only over the controlling means and, with that, a change in the process control is simplified, and the spraying nozzles, adapted to the different media, can be used.

An additional development of the invention is the multifunction strip, which makes available one to eight control channels and one to three channels, especially for air and/or water and/or release agents, as a result of which, in conjunction with selector plates between multifunction strips and spraying places, any number of spraying nozzles with spatial positions completely different, can be configured freely into a spraying group, while directly adjacent spraying places can belong to a different spraying group. With that, each spraying module, individually or as a group, is used optimally in accordance with the requirements of the corresponding casting mold portion. This leads to a jump in quality and, with that, to a decrease in the rejection rate. Due to the highly differentiated spraying to meet the requirements, there is a clear reduction in the amount of release agent used and the service life of the casting mold is lengthened due to the need-based spraying. The weight of the spraying tool is also reduced. Overall, a significant cost reduction is achieved. A further advantage of the invention also arises out of the changes, alteration or expansions of the spraying tool and/or of the spraying process, since this process can be carried out easily and quickly with the system of the multifunction strip and the selector plate.

The invention and its developments make possible a higher process safety and a reduction in the amount of release agent with its environment-contaminating admixtures. This reduces the reject rate and the costs.

The spraying of die-casting molds can be divided into four functions:

a) cleaning the molds with compressed air,
b) cooling overheated sections of the mold,
c) applying the release agent ever the whole surface of the mold affected by the material, and
d) lubricating movable parts.

Functionally, the previously used release agents, such as oil, fats, graphite admittedly are good. However, they develop toxic gases and are therefore prohibited at the present time. For this reason, the one-material water-based technique with a low proportion of release agent of about 0.5% to 5% is predominantly used at the present time. Admittedly, by these means, the functions b) to d) are accomplished with only one medium, which is adequate for simple castings. However, as soon as the castings are more complex, as is increasingly the case with the new techniques, this predominantly used method no longer is adequate, since the reject rates are too high.

The invention therefore also consists also of separating the individual functions b) from the functions c) and d), in which namely the cooling with water is regarded as an independent task and the application of release agents, which simultaneously have a lubricating effect, is a separate step. In actual fact, the two partial processes of first cooling (b) to the ideal wetting temperature and then applying (c, d) release agents start out from one place, namely either over only one spraying nozzle with correspondingly two supply lines for the two materials or two individual nozzles spraying a common area with, in each case, one material supply line. Overall, due to these reliable and constantly controllable partial processes, the reject rate and the consumption of release agent can be lowered drastically while, at the same time, the duration of the process is even shortened.

By separating the two spraying nozzle outlets, from which a common region is sprayed, it is possible, above all, to take into consideration that, for the coolant, a hard, high energy jet is appropriate and, on the other hand, for the release agent and lubricant, a soft jet. Moreover, the danger of mixing the two materials, which exists at least partly in the case of the simple spraying nozzle, does not exist here.

According to one development of the invention, the spraying nozzles may be disposed on a common spraying plate, in much the same way as described in the European patent 0 724 486 of the Applicant.

In particular, adapting the spraying range to a certain area when two spraying nozzles are used, is particularly advantageous when spraying nozzles, described in the German Offenlegungsschrift 44 37 777 of the Applicant are used.

Not least, the given invention has an important distinguishing feature in that the spraying nozzles or spraying nozzle groups, used in each case, can be programmed freely in their assignment or their use. For this purpose, a matrix on the screen of a computer is used. Not least, one development of the invention consists of the distinguishing feature that, for a mold change, the spraying plate with its spraying nozzles can be exchanged and archived in a very simple matter. The same is true for spherical nozzles, as described in the above-mentioned Offenlegungsschrift (DE 44 37 777). By these means, a comfortable and cost-effective solution is achieved, especially for small and medium-sized machines and lot sizes, while the full process optimization is retained. In every case, each spraying nozzle is supplied over a uniform air pipeline and two spraying agent pipelines using control plates, especially as described in the European patent referred to above.

The spraying nozzles are controlled by an electrical control BUS lead, electrical control valves and/or pneumatic control elements with pneumatic control channels.

The invention does not exclude the use of only one agent.

Several examples of the inventive spraying tools are described in greater detail below and shown in the drawings.

DESCRIPTION OF THE PREFERRED EMBODIMENTS

Figure 1:
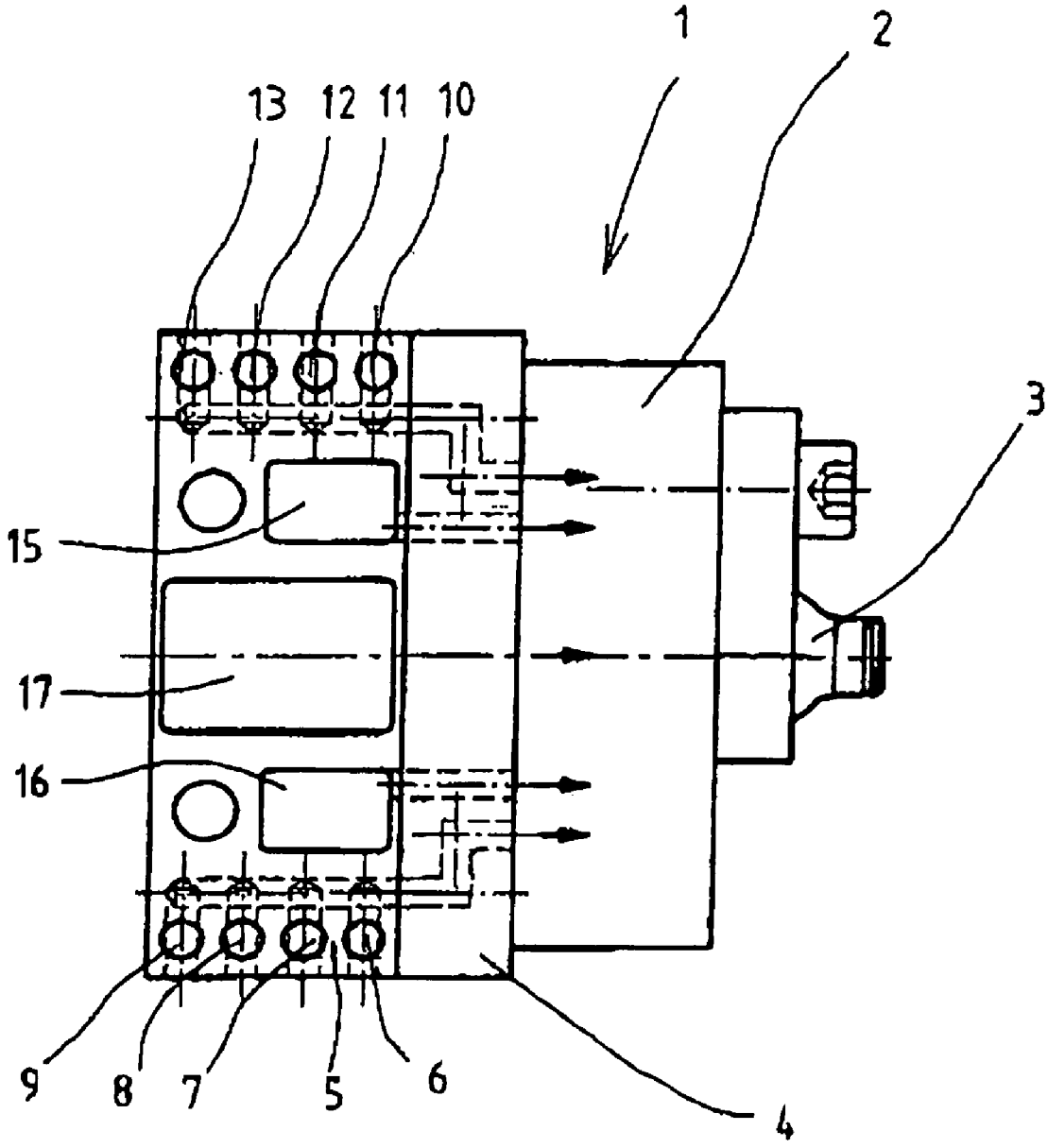
FIG. 1 shows a section through a spraying tool with one spraying place in one embodiment.

FIG. 1 shows a section through a spraying tool 1 with one spraying place 2 with a spraying nozzle 3. The selector plate 4 connects the spraying nozzle 3 with the multifunction strip 5 and, with that, makes the control of the spraying nozzle 3 possible. The multifunction strip 5 makes available eight control air channels 6-13, one release agent channel 15, one water channel 16 and an air channel 17. The spraying nozzle 3 is selected by the different control air channels 6-13 with the help of the pre-configured, exchangeable selector plate 4, so that the spraying nozzle 3 sprays either air, water or release agent.

Figure 2:
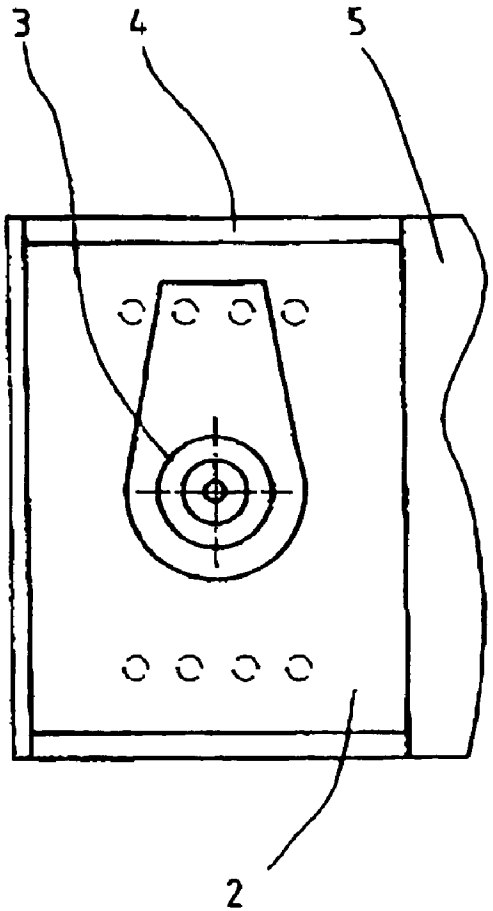
FIG. 2 shows a plan view of one spraying place with a spraying nozzle of FIG. 1.

FIG. 2 shows the plan view of FIG. 1 with one spraying nozzle 3.

Figure 3:
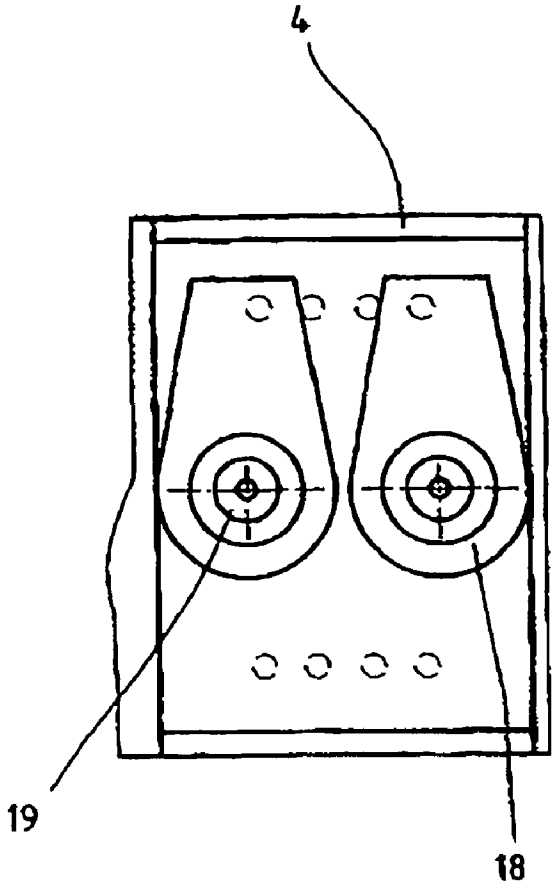
FIG. 3 shows a plan view of one spraying place with two spraying nozzles of FIG. 1.

FIG. 3 shows a first alternative, for which, instead of the one spraying nozzle 3, a spraying nozzle 18 with a soft jet for the release agent and a spraying nozzle 19 with a high-energy jet for the water or blast air is controlled also with the control air channels and a selector plate 4, which can control two spraying nozzles 18, 19.

Figure 4:
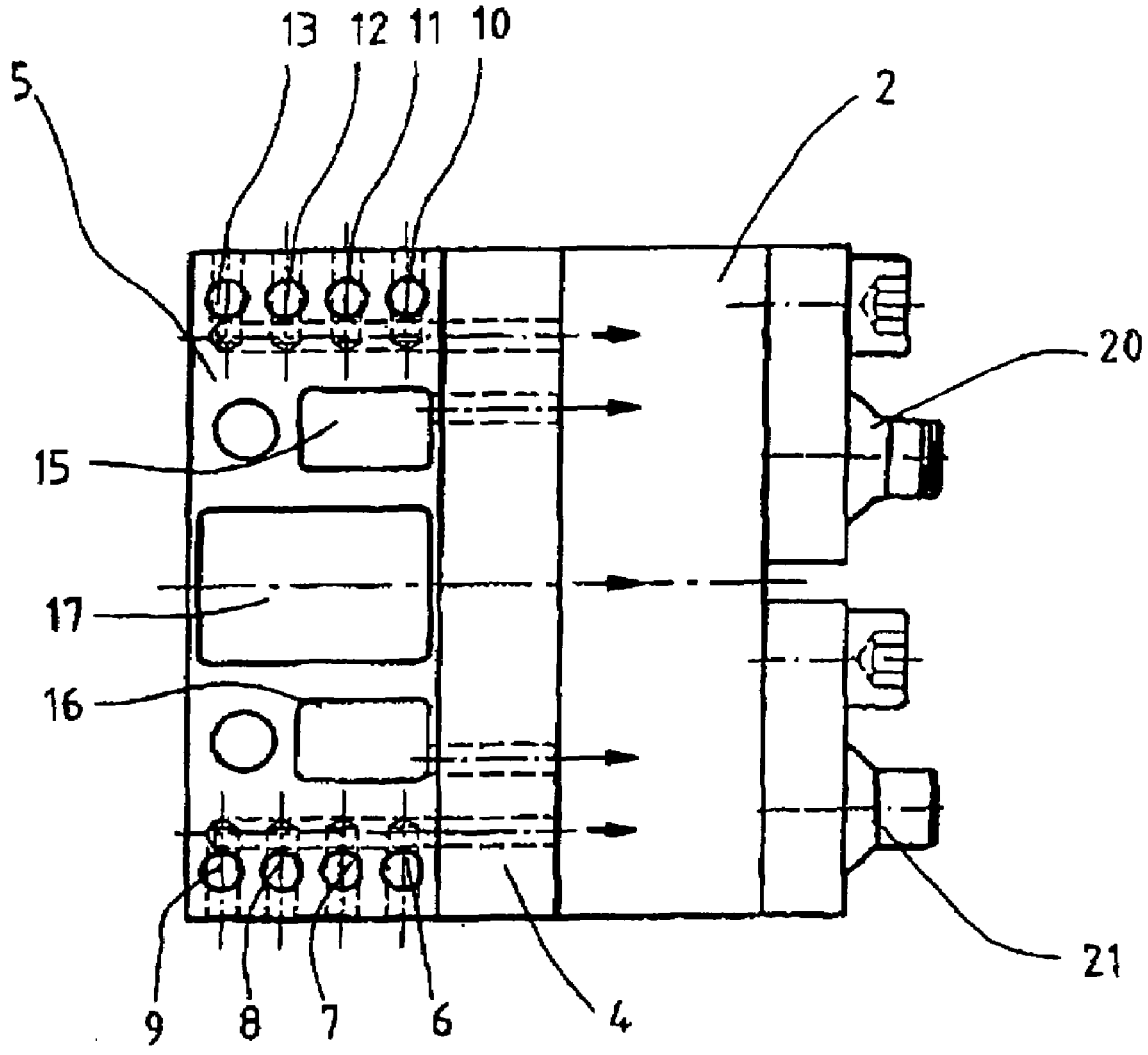
FIG. 4 shows the section through a spraying tool with one spraying place in a further embodiment.

FIG. 4 shows a section through a spraying tool in a further embodiment with a spraying place 2 with two spraying nozzles 20 and 21.

Figure 5:
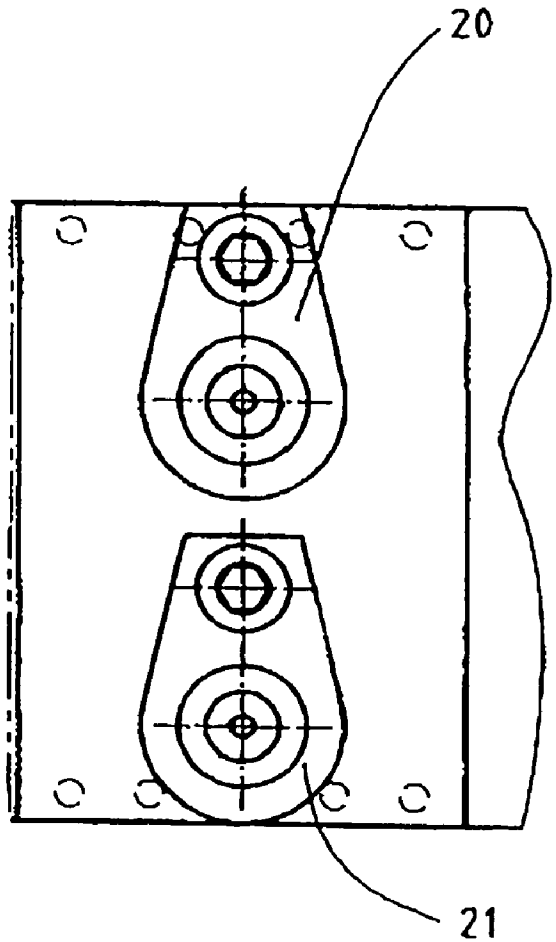
FIG. 5 shows a plan view of one spraying place with two spraying nozzles of FIG. 4.

FIG. 5 shows the plan view of FIG. 4. For this embodiment, the release agent and/or water is sprayed by the spraying nozzle 20 and the blast air by the spraying nozzle 21.

Figure 6:
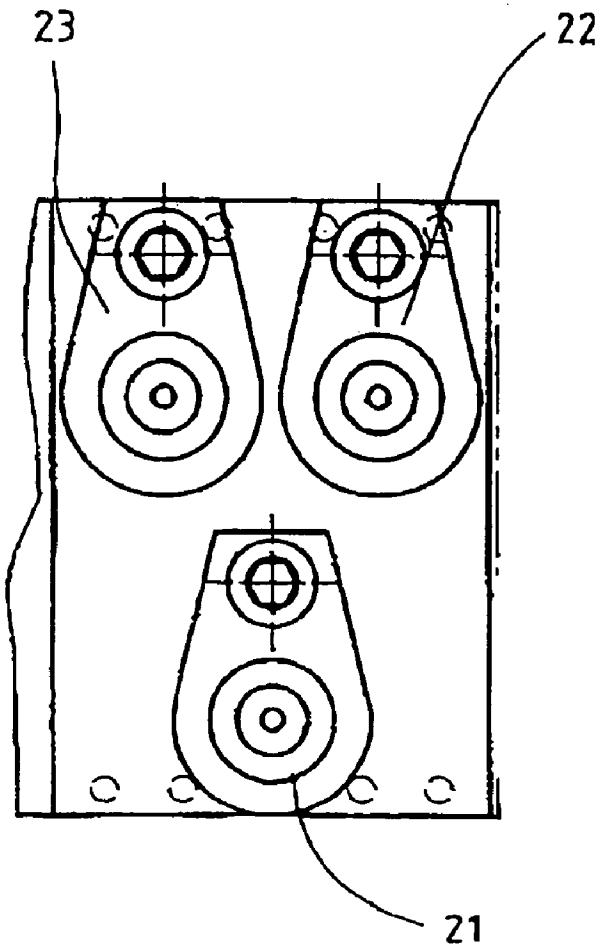
FIG. 6 shows a plan view of one spraying place with three spraying nozzles of FIG. 4.

FIG. 6 shows an expanded embodiment, for which spraying nozzle 21 is used for the blast air, the soft-adjusted spraying nozzle 22 for the release agent and the high-energy-adjusted spraying nozzle 23 for the water.

Figure 7:
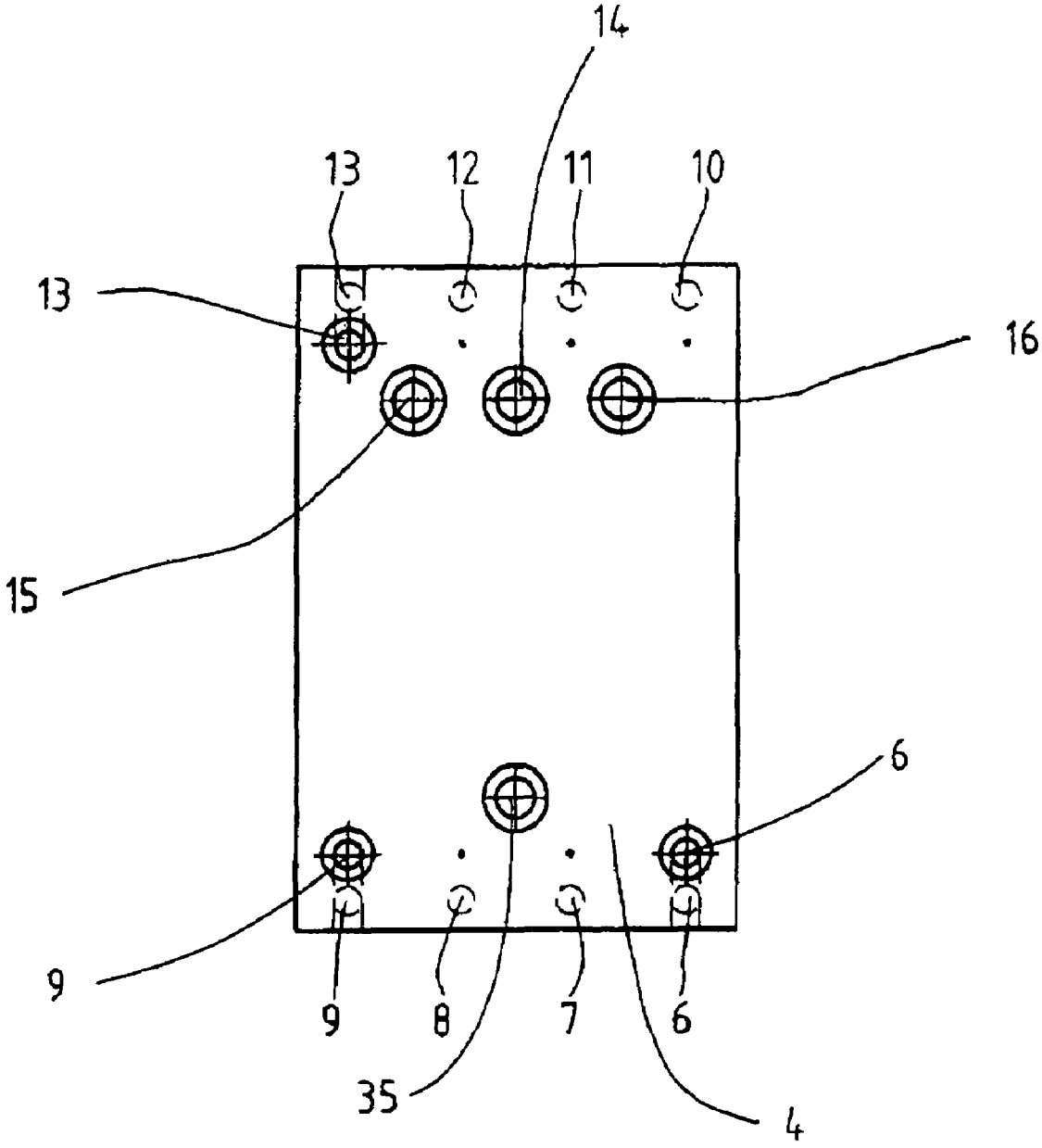
FIG. 7 shows a selector plate.

FIG. 7 shows a selector plate, for which the release agent from the release agent channel 15 is controlled together with the air from the spraying air channel 14 by the controlling air channel 13, the water channel 16 is controlled by the controlling air channels 6 and the blast air channel 35 is controlled by the controlling air channel 9.

Figure 8:
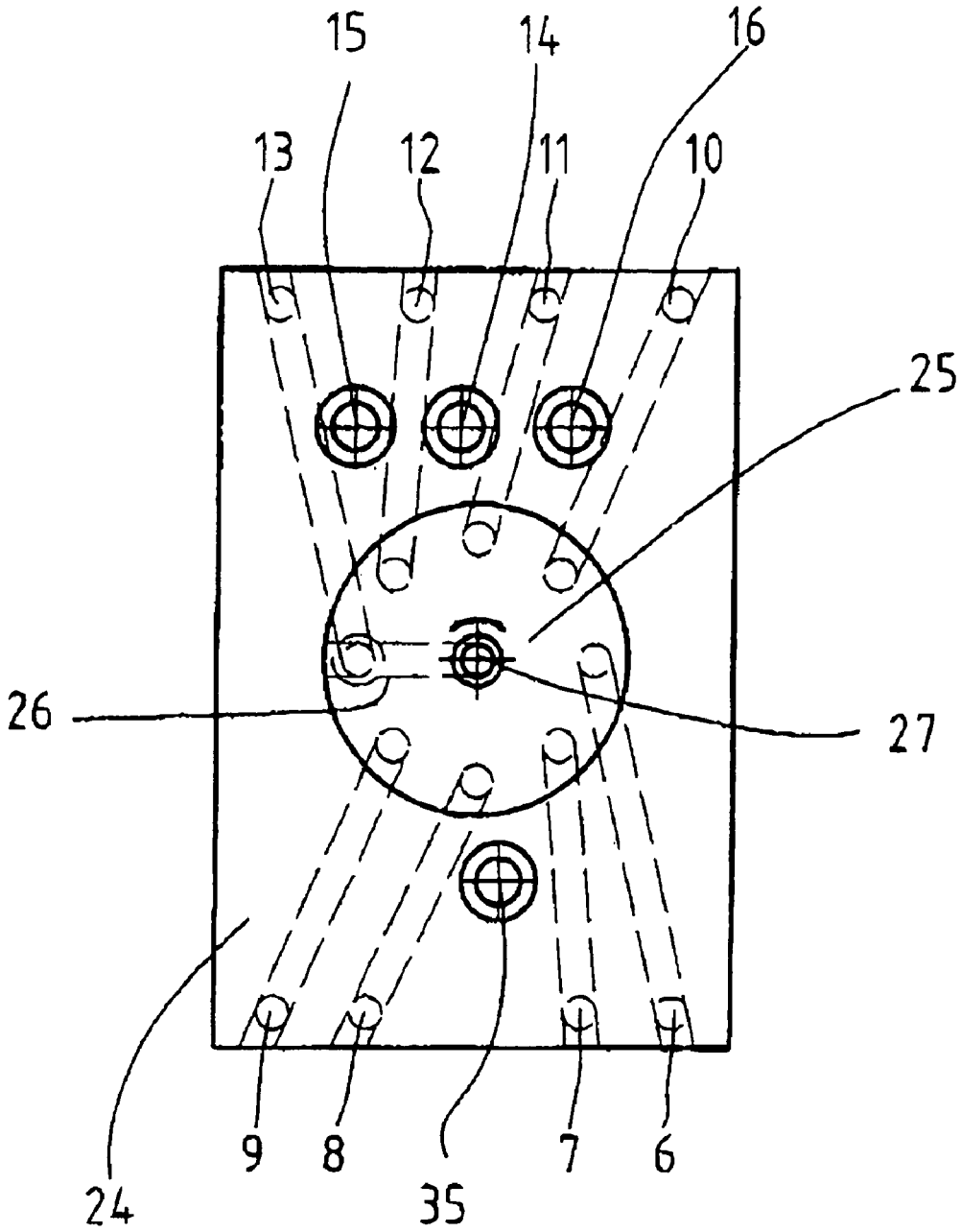
FIG. 8 shows a plate with a selector switch.

FIG. 8 shows an additional embodiment, for which, instead of the selector plate 4 with an in each case fixed configuration, a plate 24 with a selector switch 25, at which the connection 26 between the spraying nozzle entrance 27 and one of the controlling air channel 6-13 are variably adjustable. In FIG. 8, it is adjusted on the controlling air channel 13.

Figure 9:
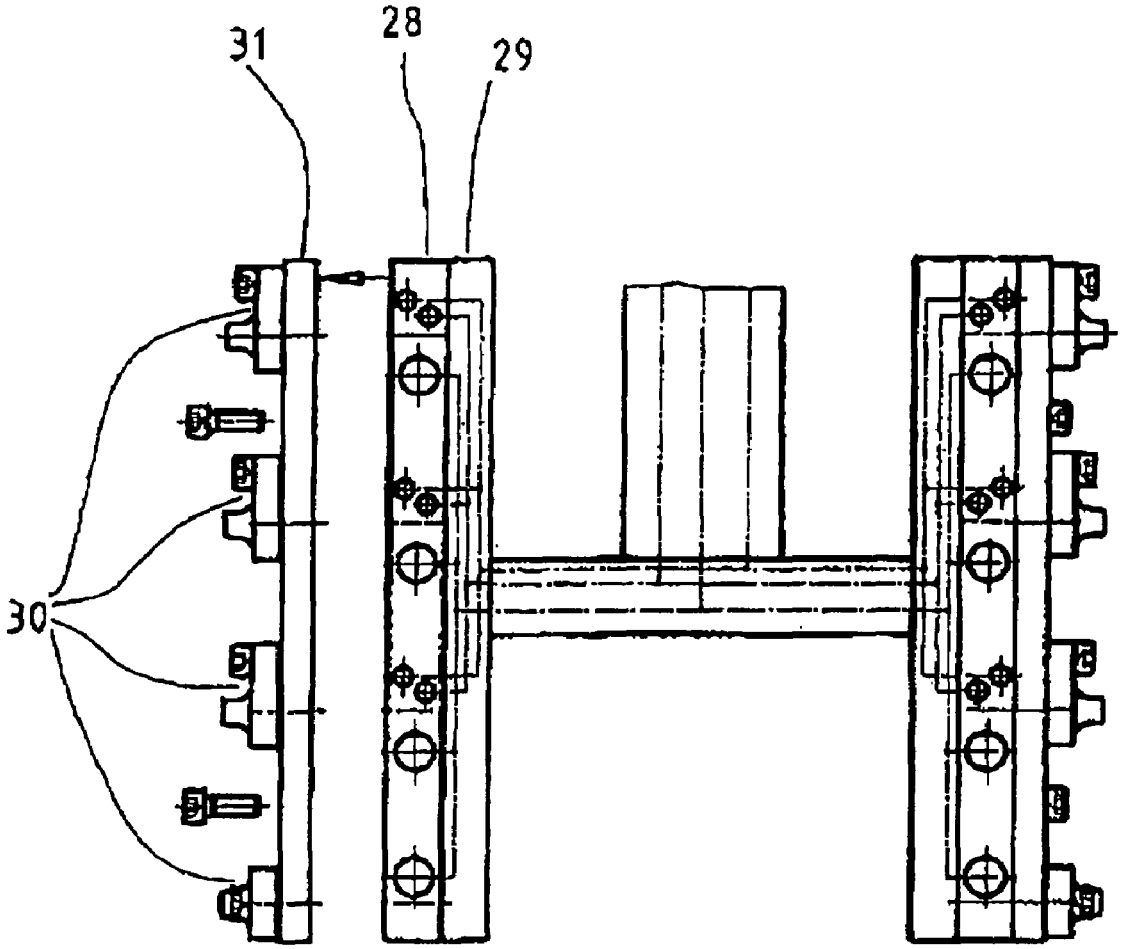
FIG. 9 shows the section through a spraying tool with a spraying plate in a different embodiment with a control plate.

FIG. 9 shows a section through a spraying tool with a control plate 28, which is mounted on a distributor plate 29, which makes the spraying media available, and an electronic bus system. After the interchangeable plate 31 is fastened on the control plate 28, the spraying nozzles 30, which are mounted on the interchangeable plate 31, can be controlled electronically over the bus system individually or in groups.

Figure 10:
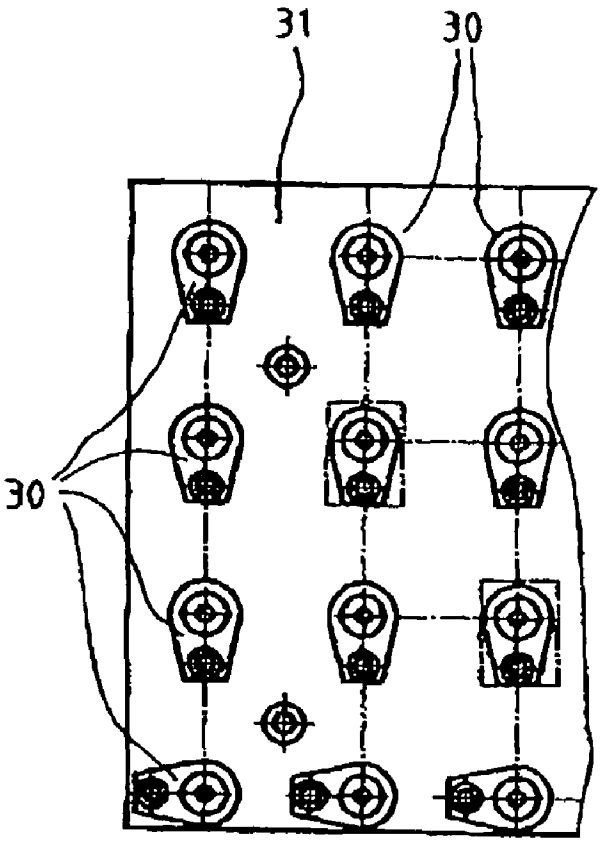
FIG. 10 shows a plan view of an interchangeable plate with a spraying nozzle for each spraying place.

FIG. 10 shows a plan view of the interchangeable plate 31 with the spraying nozzles 30.

Figure 11:
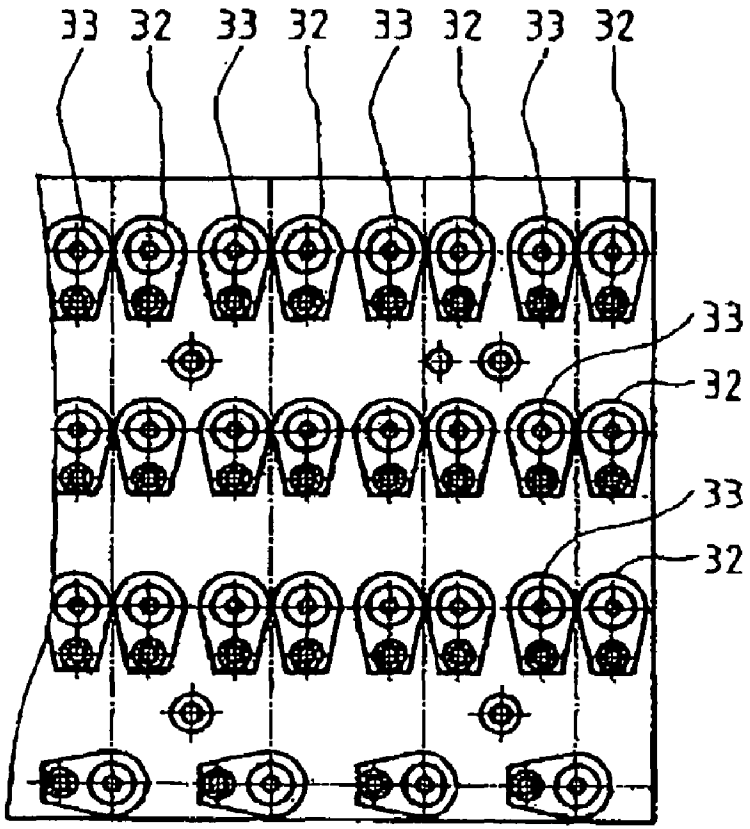
FIG. 11 shows a plan view of an interchangeable plate with two spraying nozzles for each spraying place.

FIG. 11 shows an interchangeable plate 31, on which the double spraying nozzles 32, 33 are disposed as a matrix. As described above, the water is sprayed here also through a high-energy spraying nozzle 33 and afterwards release agent is sprayed through a softly adjusted spraying nozzle 32.

System of FIGS. 9 to 11:

- individual control of spraying nozzles through pneumatic boreholes (no hoses);
- spraying nozzles disposed in matrix form on a plate;
- selection of individual spraying nozzles and configuration of spraying groups freely programmable at the screen,
- interchangeable plate for spraying devices can be archived;
- for each spraying place, two release agents can be sprayed over one spraying nozzle or, alternatively, two separate spraying nozzles;
- jointly supplying all spraying nozzles with air and two agents;
- joint control plate for all spraying nozzles, control over membrane or control piston.

System of FIGS. 1 to 8:

The spraying nozzles of the example are controlled over selector switch or selector plate and over internal control boreholes (no hoses). An electronic control bus system can also be implemented.

In particular, the following applies here:

- only one type of multifunction strip with eight control air cycles, air and two release agents;
- only internal control air channels (no hoses);
- configuring the individual spraying nozzle to a maximum of eight spraying groups manually by selector plate or selector switch;
- two release agents can be sprayed per spraying place over one spraying nozzle or alternatively two spraying nozzle;
- all spraying nozzles are supplied jointly with, first of all, air and secondly release agent;
- spraying nozzles controlled over a membrane or control piston.

All distinguishing features, shown in the specification, the claims that follow and the drawing, may be essential to the invention individually, as well as in any combination with one another.

LIST OF REFERENCE SYMBOLS

1 spraying tool
2 spraying place
3 spraying nozzle

4 selector plate
5 multifunction strip
6-13 control air channel
14 spraying air channel
15 release agent channel
16 water channel
17 air channel
18-23 spraying nozzle
24 plate
25 selector switch
26 connection
27 spraying nozzle access
28 control plate
29 distributor plate
30 spraying nozzle
31 interchangeable plate
32, 33 spraying nozzle
35 blast air channel

The invention claimed is:

1. A spraying tool for foundry molds, for at least one of blowing out, cooling or treating, the treating including at least one of wetting or lubricating with at least one medium, the spraying tool comprising:

a spraying place including at least one spraying nozzle;

an appropriating apparatus including structure defining channels via which media having differing characteristics are made available to said spraying place; and at least one control apparatus interposed between the appropriating apparatus and the spraying place, said control apparatus including bores appropriately configured to provide selective communication between said at least one spraying nozzle and a corresponding one or ones of the channels supplying a desired one or ones of the media, for controlling supply of said desired one or ones of the media to said at least one spraying nozzle.

2. The spraying tool according to claim 1, wherein:

the appropriating apparatus is a multifunction strip which includes said channel, said channels including at least one control air channel and at least one spraying medium; and/or the control apparatus is a selector plate or a plate with selector switches.

3. A spraying tool for foundry molds, for at least one of blowing out, cooling or treating, the treating including at least one of wetting or lubricating with at least one medium, the spraying tool comprising:

an appropriating apparatus at which at least one medium is made available, said appropriating apparatus including a multifunction strip which has at least one control air channel and at least one spraying medium, and/or the control apparatus is a selector plate or a plate with selector switches;

at least one control apparatus disposed at the appropriating apparatus; and a spraying place disposed at said control apparatus and having at least one spraying nozzle controllable by the control apparatus, wherein the multifunction strip makes available at least one of control air channels, at least one spraying air channel, at least one channel for a release agent, a channel for water or at least one blast air channel and at least one spraying nozzle and at least one of at least one selector plate or at least one plate with selector switches are controllable by the control air channels.

4. A spraying tool for foundry molds, for at least one of blowing out, cooling or treating, the treating including at least one of wetting or lubricating with at least one medium, the spraying tool comprising:

an appropriating apparatus at which at least one medium is made available;

spraying places disposed at said control apparatus, each of said spraying places having at least one spraying nozzle controllable by the control apparatus;

at least one control apparatus disposed at the appropriating apparatus, the control apparatus comprising an electronically controllable control plate which is fixed at one side at the appropriating apparatus, which is a distributor plate, and an interchangeable plate being disposed on another side thereof, on which the spraying places are disposed as a matrix.

5. The tool according to claim 4, wherein the spraying nozzles are controllable electronically by the control plate and programmed freely over a screen which is connected over a bus system with the control plate.

6. The tool according to claim 5, wherein the spraying nozzles are programmable at least one of individually or in groups.

7. The tool according to claim 1, wherein said at least one spraying nozzle includes a spraying nozzle for said desired one or ones of the media.

8. The tool according to claim 7, wherein at least two of said desired one or ones of said media are sprayable consecutively or simultaneously by the at least one spraying nozzle.

9. A spraying tool for foundry molds, for at least one of blowing out, cooling or treating, the treating including at least one of wetting or lubricating with at least one medium, the spraying tool comprising:

an appropriating apparatus at which at least one medium is made available;

at least one control apparatus disposed at the appropriating apparatus; and a spraying place disposed at said control apparatus and having at least one spraying nozzle controllable by the control apparatus, wherein said spraying place includes two spraying nozzles, one of which is provided for at least one of the medium of a release agent or air and an other for at least one of the medium of water or air.

10. A spraying tool for foundry molds, for at least one of blowing out, cooling or treating, the treating including at least one of wetting or lubricating with at least one medium, the spraying tool comprising:

an appropriating apparatus at which at least one medium is made available;

at least one control apparatus disposed at the appropriating apparatus; and a spraying place disposed at said control apparatus and having three spraying nozzles a first of said three spaying nozzles is for the medium of air, a second of said three spaying nozzles for the medium of water and a third of said three spaying nozzles for the medium of a release agent.

11. The tool according to claim 7, wherein said desired one or ones of the media is sprayable together with at least one further one of the media.

12. The tool according to claim 1, wherein media include a release agent which comprises an admixture of at least one of wax, oil or silicone, a remainder being water.

13. The tool according to claim 3, wherein said control air channels comprise eight air channels.

14. A spraying tool for foundry molds, for at least one of blowing out, cooling or treating, the treating including at least one of wetting or lubricating with at least one medium, the spraying tool comprising:

an appropriating apparatus at which at least one medium is made available;

at least one control apparatus disposed at the appropriating apparatus; and at least one spraying place disposed at said control apparatus and having at least one spraying nozzle for at least one medium controllable by the control apparatus, wherein the at least one medium is at least one of a release agent, water or air.

15. The tool according to claim 8, wherein two or three of said media are sprayable consecutively or simultaneously with said at least one spraying nozzle.

16. The tool according to claim 11, wherein said desired one or ones of the media comprises a release agent and/or water and the at least one further one of the media comprises air.

17. The tool according to claim 3, wherein said at least one spraying nozzle includes two to three spraying nozzles.

18. The tool according to claim 1, wherein said control apparatus includes a pre-configured, exchangeable selector plate.

19. The tool according to claim 1, wherein said control apparatus includes a selector plate including a selector switch operable to selectively distribute said desired one or ones of the media made available at the appropriating apparatus to said at least one spraying nozzle.

* * * * *